United States Patent [19]

Kubo et al.

[11] 4,381,651

[45] May 3, 1983

[54] SILENCER IN A REFRIGERATION SYSTEM

[75] Inventors: Koji Kubo; Mineo Nishikawa, both of Kariya; Hikaru Sugi, Nagoya, all of Japan

[73] Assignee: Nippondenso Co., Ltd., Kariya, Japan

[21] Appl. No.: 283,913

[22] Filed: Jul. 16, 1981

[30] Foreign Application Priority Data

Jul. 17, 1980 [JP] Japan ..... 55-96891

[51] Int. Cl.[3] ..... F25D 19/00

[52] U.S. Cl. ..... 62/296

[58] Field of Search ..... 62/296; 181/403

[56] References Cited

U.S. PATENT DOCUMENTS 2,986,017 5/1961 Butts ..... 62/296 X

FOREIGN PATENT DOCUMENTS 188351 1/1957 Fed. Rep. of Germany ..... 62/296

*Primary Examiner*—Lloyd L. King

*Attorney, Agent, or Firm*—Cushman, Darby & Cushman

[57] ABSTRACT

When a fluid is jetted from an orifice having a small diameter into an ample space having a much greater cross-sectional area than the orifice, as in the case of a refrigerant jetted from a restriction or orifice into a refrigerant pipe of a refrigeration system, jet noise of high frequency is generated in the region around the orifice. In order to suppress the generation of this jet noise, the present invention provides a silencer which includes a casing, an orifice of a small diameter arranged in the casing for jetting a refrigerant into the casing and an obstruction disposed in the casing at a position within a distance which is 5 times as large as the diameter of the orifice. The obstruction can have various forms such as bar-like form, disc-like form and so forth and can be made from various materials such as rubbers, plastics and metals. The obstruction disposed at such a position cause a change of pattern of the fluid flow to effectively suppress the generation of noise.

4 Claims, 12 Drawing Figures

SILENCER IN A REFRIGERATION SYSTEM

BACKGROUND OF THE INVENTION

The present invention relates to a silencer in a refrigeration system for silencing a jet noise produced as a result of an adiabatic expansion of refrigerant in a restriction constituting a pressure reducing device of the refrigeration system of a room air conditioner, refrigerator, automobile air conditioner or the like.

In the room air conditioners, refrigerators, automobile air conditioners or the like having a refrigeration system incorporating a fixed restriction or a capillary tube constituting a pressure reducing device, a jet noise of a high level is generated due to an adiabatic expansion of the refrigerant at the outlet side of the pressure reducing device and due to a drastic increment of the cross-sectional area of the refrigerant pipe. The level of the jet noise becomes higher as the pressure difference or pressure drop of the refrigerant across the restriction becomes greater. Particularly, in the case where the refrigeration system operates discontinuously or by an on-off control, the gaseous refrigerant in the two-phase flow of refrigerant makes a rapid adiabatic expansion to periodically produce large noise. It has been confirmed that this jet noise is maximized immediately after the stopping or starting of the compressor.

This jet noise imparts quite an unpleasant feel to the user, and there is an increasing demand for eliminating or suppressing this jet noise.

Generally, as to the jet noise produced by a fluid jetted from a nozzle or the like, the following phenomenon are observed. A so-called jet core of an equal potential energy level is distributed in the region of a distance 4D (D represents the diameter of nozzle) from the nozzle. This region is generally referred to as mixing region. As the fluid is jetted, numerous eddy currents are formed in the boundary between the mixing region of the jet and the ambient fluid, to generate a noise of a high frequency. Also, a noise of low frequency is generated in the boundary region between the mixing region and a region of turbulent flow formed at the downstream side of the mixing region. It is considered that the noise energy is distributed making this boundary region substantially as a center.

This characteristic of jet noise applies also to the jet noise generated in the restriction of refrigerant passage in the refrigeration system. Particularly, the high frequency noise generated in the mixing region imparts an unpleasant feel.

SUMMARY OF THE INVENTION

It is, therefore, a principal object of the invention to provide a silencer capable of effectively suppressing the generation of the jet noise.

The present inventors have found, as a result of various studies and experiments, that the structure of the turbulent jet flow is largely changed by an obstruction which is located within a distance 5D or five times as large as the diameter D of the nozzle opening from the end surface of the latter, to reduce the energy which causes the high-frequency noise in the boundary between the jet mixing region and the peripheral fluid, as well as the acoustic energy.

The present invention aims at providing a silencer which carries out the above-described principle.

Namely, according to the invention, there is provided a silencer in a refrigeration system comprising, a casing, an orifice of a small diameter arranged in said casing for jetting a refrigerant into said casing and an obstruction disposed in said casing at a position spaced from said orifice within a distance which is five times as large as the diameter of said orifice, whereby generation of jet noise generated when said refrigerant is jetted from said orifice is suppressed.

The silencer of the invention is not expensive and simple in construction but can perform a remarkable silencing effect.

If a reflector is incorporated in the silencer or if a deflector or small apertures are formed in the refrigerant passage of the silencer, the noise reflecting and attenuation effects are increased to prevent the propagation of the jet noise to the downstream side of the fluid pipe.

The above and other objects, as well as advantageous features of the invention will become more clear from the following description of the preferred embodiments taken in conjunction with the accompanying drawings.

DESCRIPTION OF THE PREFERRED EMBODIMENTS

The invention will be described more fully hereinafter through preferred embodiments applied to a refrigeration cycle, with reference to the drawings.

Figure 1:
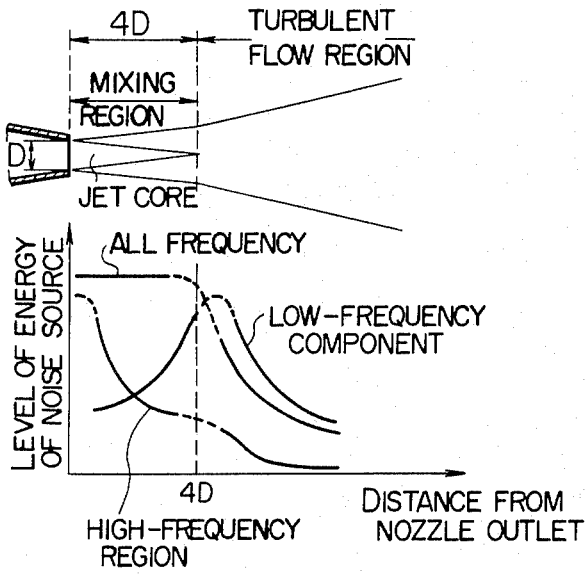
FIG. 1 is an illustration of the jet noise.

Referring first to FIG. 1 illustrating the mechanism of generation of the jet noise, jet core is distributed in the jet mixing region which is, as stated before, within a distance 4D which is four times as large as the diameter D of a nozzle from which a fluid is jetted. In this jet mixing region, as shown in the graph in the lower half part of this Figure, the high-frequency component of the noise is generated by numerous eddy currents formed in the boundary between the mixing region and the peripheral fluid, while the low-frequency component of the noise is produced by eddy currents which are formed in the boundary between the mixing region and a turbulent flow region which is formed at the downstream side of the mixing region and is distributed around this boundary. In consequence, the noise has a frequency distribution as illustrated by the curve of this Figure.

Figure 2:
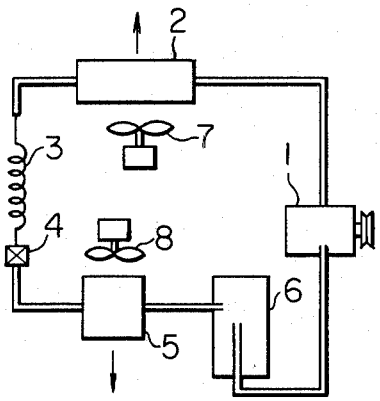
FIG. 2 schematically shows a refrigeration system.

Referring now to FIG. 2 schematically showing a refrigeration system, the refrigeration system has a compressor 1, condenser 2, capillary tube 3, a fixed restriction 4, evaporator 5 and an accumulator 6 arranged to form a closed circuit wherein a refrigerant flows in the above-mentioned order therethrough. Numerals 7 and 8 designate blowers.

Figure 3:
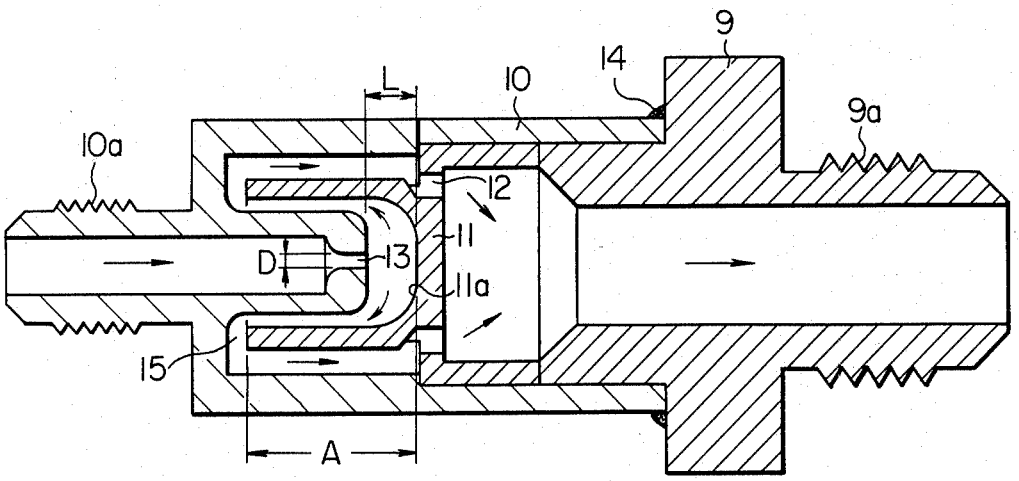
FIG. 3 is an enlarged sectional view of a silencer constructed in accordance with an embodiment of the invention.

FIG. 3 shows a silencer in accordance with the invention, for suppressing the generation of noise in the fixed restriction 4 of the refrigeration system. The silencer has a casing including two cylindrical parts 9, 10 made of aluminum which are jointed to each other by welding over the entire circumference of juncture thereof as at 14. The silencer has connection screw threads 9*a*, 10*a* at which it is screwed in a gas tight manner to the refrigerant pipes at the fixed restriction 4. A reference numeral 13 denotes a fixed orifice having a small aperture of a circular cross-section. According to the invention, an obstruction 11 is disposed in the casing such that its inner surface 11*a* is located at a distance L between 4D and 5D (D represents the diameter of the aperture of the orifice 13) from the aperture. By disposing the obstruction 11 in this region, it is possible to largely suppress the generation of noise, i.e. to obtain a large silencing effect.

The obstruction 11 is made of aluminum and has a cup-shaped reflecting surface constituted by the inner surface 11*a* to prevent the radiation of noise to the outside. The noise reflecting and attenuation effects are enhanced by a deflecting portion 15 of the fluid passage and small apertures 12 disposed concentrically around the base portion of the obstruction 11, so that the propagation of the noise to the downstream side of the refrigerant pipe is effectively suppressed. The small aperture 12 can have various possible shapes such as circular shape, star-like shape and so forth. The length A between the deflecting portion 15 and the inner surface 11*a* is preferably selected to be greater than the aforementioned distance L, so that the end surface of the orifice aperture may be completely surrounded by a cylindrical portion of the obstruction 11.

Figure 4A:
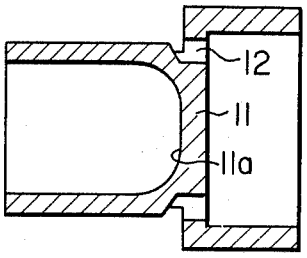
FIG. 4*a* is a sectional view of an obstruction incorporated in the silencer shown in FIG. 3.
Figure 4B:
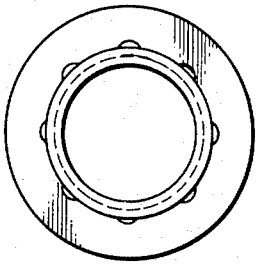
FIGS. 4*b* and 4*c* are left and right side elevational views of the obstruction shown in FIG. 4*a;*
Figure 4C:
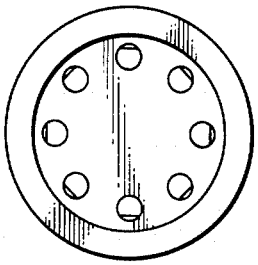

The shape and construction of the obstruction 11 will be seen more clearly from FIGS. 4*a* and 4*b*.

Figure 5A:
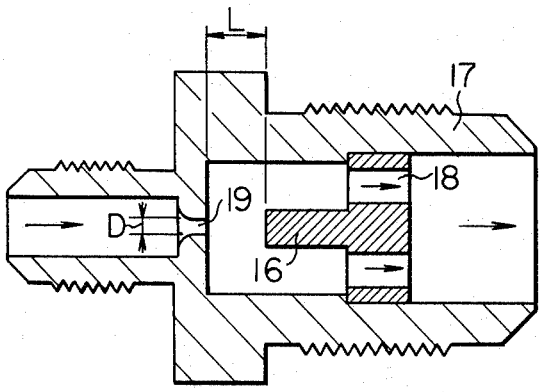
FIG. 5*a* is an enlarged sectional view of another embodiment.
Figure 5B:
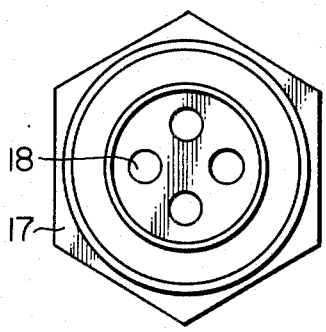
FIG. 5*b* is a side elevational view of the embodiment shown in FIG. 5*a;*

FIGS. 5*a* and 5*b* in combination show a simplified form of the silencer shown in FIG. 3. Namely, the silencer shown in FIGS. 5*a* and 5*b* has a bar-shaped obstruction 16 made of aluminum and pressed into the casing 17 of the silencer. In this silencer also, small apertures 18 are formed concentrically around the base portion of the bar-shaped obstruction 16. It is confirmed through experiments that, as in the case of the first embodiment shown in FIG. 3, a remarkable silencing effect is obtained when the distance L between the end surface of the orifice 19 and the end of the bar-shaped obstruction 16 is selected to fall between 4D and 5D, representing the diameter of aperture of the orifice 19 by D.

Figure 6:
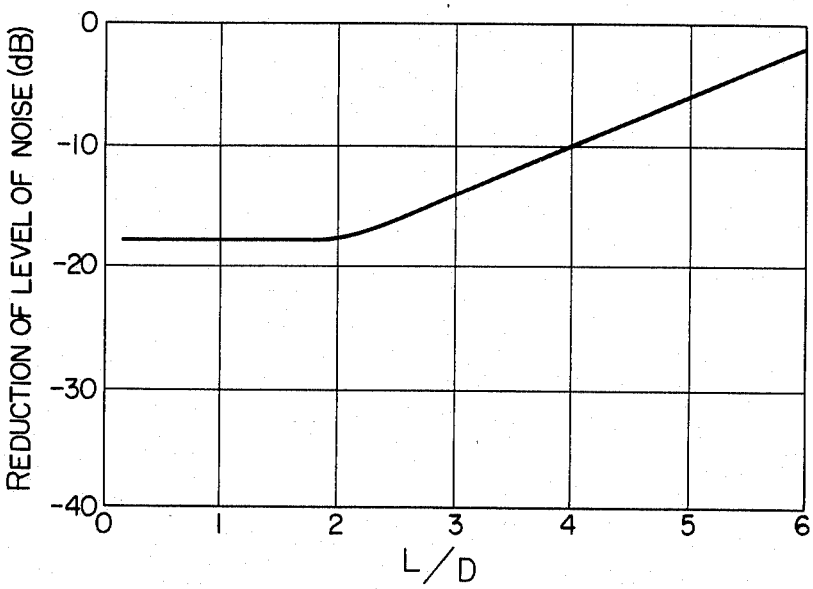
FIG. 6 is a graph showing how the silencing effect is changed by the change of position of a bar-shaped obstruction incorporated in the embodiment shown in FIGS. 5*a* and 5*b;*

FIG. 6 shows how the silencing effect is changed by a change of the position of the bar-shaped obstruction shown in FIG. 5*a* on the assumption that the diameter D of the aperture of orifice is 1.5 mm. This figure shows particularly the reduction of level of high-frequency noise of a region around 8000 Hz, with the axis of ordinate and axis of abscissa representing, respectively, the reduction of level of noise (dB) and the ratio L/D.

Figure 7:
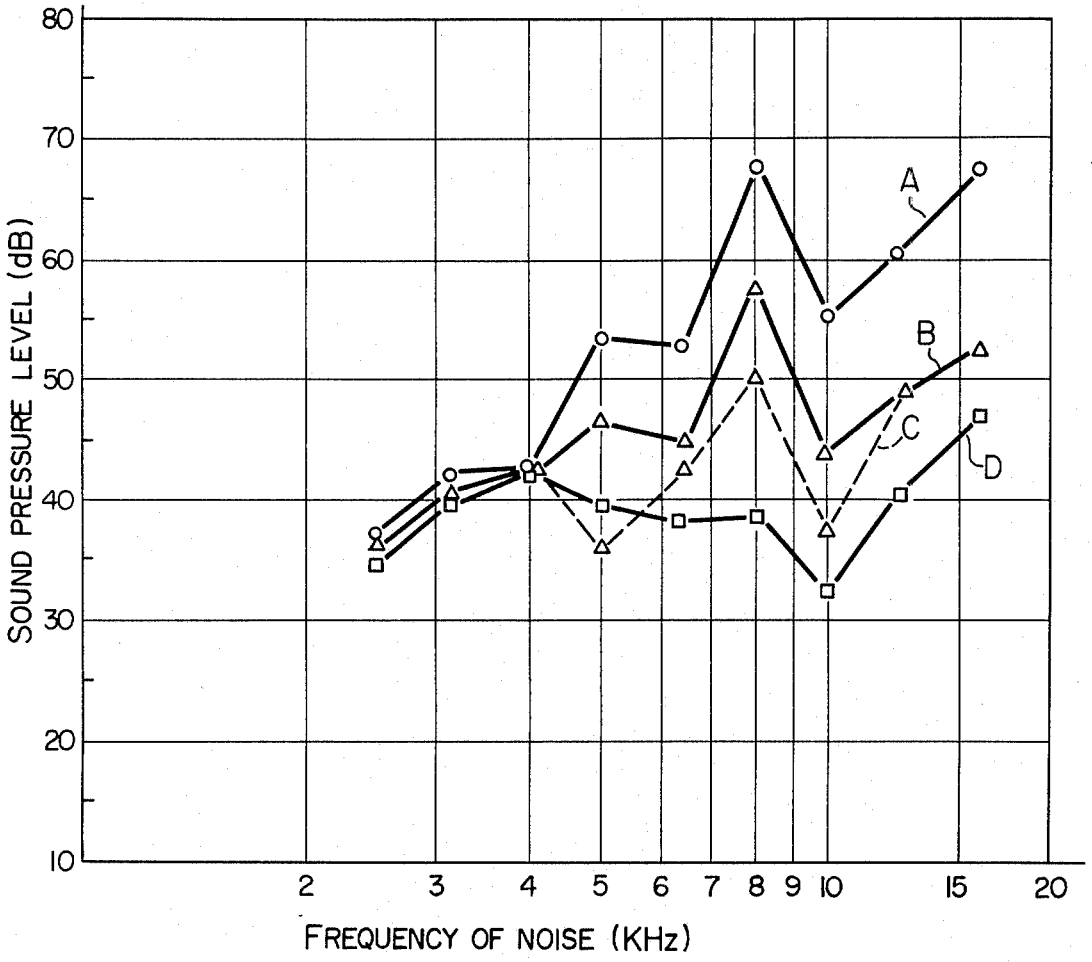
FIG. 7 is a graph showing the silencing effects of the silencers shown in FIG. 3 and 5*a*, 5*b;*

FIG. 7 is a graph showing the silencing effects as performed by the silencers shown in FIG. 3 and FIG. 5*a*. In this graph, the axis of abscissa represents in a logarithmic scale the frequency (KHz) of the noise while axis of ordinate represents the sound pressure level (dB). The curves A to D show the frequency spectra as obtained in the following cases.

Curve A: spectrum obtained when no silencer is provided in the fixed orifice

Curve B: spectrum obtained when the silencer shown in FIG. 5*a* is disposed in the fixed orifice (D=1.5 mm, L=4D)

Curve C: spectrum obtained when the silencer shown in FIG. 5*a* is disposed in the fixed orifice (D=1.5 mm, L=2D)

Curve D: spectrum obtained when a silencer shown in FIG. 3 is disposed in the fixed orifice (D=1.6 mm, L=3D)

From this graph, it will be seen that the silencers shown in FIGS. 3 and 5*a* exhibit remarkable silencing effects particularly in the high-frequency region of the jet noise in which the unpleasant feel imparted by the jet noise is most serious.

Figure 8A:
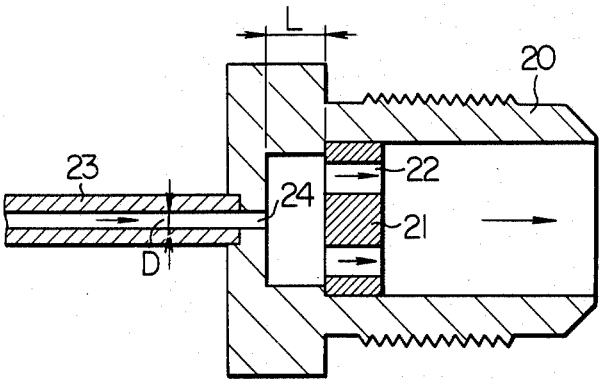
FIG. 8*a* is an enlarged sectional view of still another embodiment of the invention.
Figure 8B:
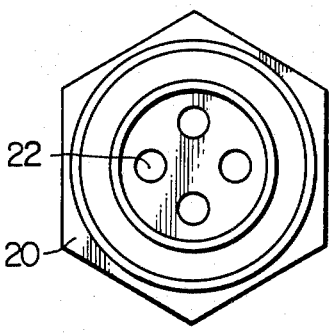
FIG. 8*b* is a side elevational view of the embodiment shown in FIG. 8*b*.

FIGS. 8*a* and 8*b* shows an example of the silencer suitable for use in suppressing the jet noise which is generated at the outlet of the capillary where the cross-sectional area of the refrigerant passage is increased drastically, in a household air conditioner or refrigerator. The principle of operation of this silencer is materially identical to that of the silencer shown in FIG. 5*a*. In this case, a disc-shaped obstruction 21 having peripheral small apertures 22 is forcibly fitted in a casing 20 of the silencer, such that the inner surface of the obstruction 21 is disposed within a distance which is four to five times as large as the diameter D of the outlet opening 24 of the capillary 23 from the end surface of the latter.

The forms of the obstruction described heretofore are not exclusive, and the obstruction can have various other forms. As to the material of the obstruction, rubbers and plastics are usable practically. However, in order to avoid degradation of the performance of the refrigeration system, it is preferred not to adopt such a form of the obstruction as would cause a large increase of the flow resistance.

As stated before, the high-frequency component of the jet noise is generated in the mixing region shown in FIG. 1 where the jet core is distributed.

According to the invention, the acoustic energy of the noise source is diminished by the obstruction disposed in the jet core. This mixing region usually stretches between the outlet of the orifice and a point which is spaced from the outlet by a distance about four times as large as the diameter of the outlet opening. It will be seen that the obstruction disposed within a distance four to five times as large as the diameter of the outlet opening from the latter can effectively suppress the generation of noise to provide a remarkable silencing effect.

The forms of the obstruction heretofore described are only examples, and various other forms can be adopted. The silencing effect will be further enhanced if the outlet of the orifice is surrounded by a curved reflecting body, as well as by a deflecting portion, apertured body or porous body disposed in the flow passage in the silencer.

The obstruction can be made of various materials such as rubbers, plastics, metals and so forth, and can be fixed in the casing of the silencer by various means such as screws, press-fitting, welding and so forth. Alternatively, the obstruction may be formed as a unit with the casing of the silencer.

The silencer of the invention can be applied theoretically to the suppression of the jet noise which is generated in an opened space, not only to the described case where the jet noise is generated in a pipe.

Thus, the silencer of the invention finds wide use such as pneumatic apparatus, hydraulic apparatus and so forth.

The small apertures in the restricting portion can have an other form than the described circular form.

What is claimed is:

1. A silencer in a refrigeration system comprising a casing, an orifice of a small diameter arranged in said casing for jetting a refrigerant into said casing and an obstruction disposed in said casing at a position spaced from said orifice within a distance which is between two and five times as large as the diameter of said orifice, whereby generation of jet noise generated when said refrigerant is jetted from said orifice is suppressed, said obstruction having a bar-shaped central portion projecting from a disc-like base portion toward said orifice, said base portion having a peripheral portion and being provided with a plurality of small aperture formed in said peripheral portion thereof.

2. A silencer as claimed in claim 1, wherein said obstruction has a noise reflecting portion surrounding said orifice.

3. A silencer as claimed in claim 1 or 2, wherein a flow deflecting portion is formed in the refrigerant passage in said silencer.

4. In combination with a refrigeration system comprising a compressor, a condenser, a capillary tube, a fixed restriction, an evaporator and an accumulator arranged to form a closed circuit such that a refrigerant flows in the above-mentioned order therethrough; a silencer incorporating said fixed restriction comprising a casing, an orifice of a small diameter arranged in said casing for jetting a refrigerant into said casing and an obstruction disposed in said casing at a position spaced from said orifice within a distance which is at least two times as large as the diameter of said orifice.

* * * * *